US005983209A

United States Patent [19]

Kara

[11] Patent Number: 5,983,209

[45] Date of Patent: Nov. 9, 1999

[54] SYSTEM AND METHOD FOR DETERMINATION OF POSTAL ITEM WEIGHT BY CONTEXT

[75] Inventor: Salim G. Kara, Houston, Tex.

[73] Assignee: E-Stamp Corporation, Houston, Tex.

[21] Appl. No.: 08/729,669

[22] Filed: Oct. 2, 1996

[51] Int. Cl.[6] ..... G07B 17/02

[52] U.S. Cl. ..... 705/407; 705/410

[58] Field of Search ..... 177/25.15; 364/464.1, 364/464.11, 464.16, 464.17, 464.2, 478.08; 705/400, 401, 406, 407, 410

[56] References Cited

U.S. PATENT DOCUMENTS

| | | | |
|---|---|---|---|
| 4,571,925 | 2/1986 | Adams | 53/502 |
| 4,639,873 | 1/1987 | Baggarly et al. | 705/406 |
| 4,641,347 | 2/1987 | Clark et al. | 380/3 |
| 4,725,718 | 2/1988 | Sansone et al. | 235/495 |
| 4,734,865 | 3/1988 | Scullion et al. | 364/478.1 |
| 4,743,747 | 5/1988 | Fougere et al. | 235/494 |
| 4,757,537 | 7/1988 | Edelmann et al. | 380/51 |
| 4,763,271 | 8/1988 | Field | 364/466 |
| 4,775,246 | 10/1988 | Edelmann et al. | 380/23 |
| 4,797,830 | 1/1989 | Baggarly et al. | 705/406 |
| 4,800,505 | 1/1989 | Axelrod et al. | 364/478.09 |
| 4,800,506 | 1/1989 | Axelrod et al. | 364/478 |
| 4,802,218 | 1/1989 | Wright et al. | 380/23 |
| 4,809,187 | 2/1989 | Adams | 705/406 |
| 4,812,994 | 3/1989 | Taylor et al. | 364/464.02 |
| 4,817,042 | 3/1989 | Pintsov | 364/478.08 |
| 4,821,493 | 4/1989 | Pintsov | 53/502 |
| 4,829,443 | 5/1989 | Pintsov et al. | 705/406 |
| 4,831,555 | 5/1989 | Sansone et al. | 364/519 |
| 4,864,618 | 9/1989 | Wright et al. | 380/51 |
| 4,868,757 | 9/1989 | Gil | 364/464.03 |
| 4,900,903 | 2/1990 | Wright et al. | 235/380 |
| 4,900,904 | 2/1990 | Wright et al. | 235/381 |
| 4,901,241 | 2/1990 | Scheck | 364/464.02 |
| 4,959,795 | 9/1990 | Christensen et al. | 705/407 |
| 5,065,000 | 11/1991 | Pusic | 235/381 |
| 5,067,305 | 11/1991 | Baker et al. | 53/411 |
| 5,111,030 | 5/1992 | Brasington et al. | 235/375 |
| 5,119,306 | 6/1992 | Metelis et al. | 705/406 |
| 5,177,687 | 1/1993 | Baggarly et al. | 705/406 |
| 5,200,903 | 4/1993 | Gilham | 364/464.02 |
| 5,239,168 | 8/1993 | Durst, Jr. | 235/432 |
| 5,264,665 | 11/1993 | Delfer, III | 177/25.15 |
| 5,319,562 | 6/1994 | Whitehouse | 364/464.03 |
| 5,367,450 | 11/1994 | Pintsov | 705/8 |
| 5,383,129 | 1/1995 | Farrell | 705/401 |
| 5,476,255 | 12/1995 | Murcko et al. | 271/109 |
| 5,510,992 | 4/1996 | Kara | 235/380 X |
| 5,538,232 | 7/1996 | Long | 270/1.03 |
| 5,628,249 | 5/1997 | Cordery et al. | 101/91 |
| 5,655,023 | 8/1997 | Cordery et al. | 380/51 |
| 5,684,706 | 11/1997 | Harman et al. | 364/468.01 |

FOREIGN PATENT DOCUMENTS

| | | |
|---|---|---|
| 0137737 | 9/1984 | European Pat. Off. . |
| 2580844 | 4/1986 | France . |
| 2251210 | 12/1990 | United Kingdom . |
| 8801818 | 3/1988 | WIPO . |

*Primary Examiner*—Edward R. Cosimano
*Attorney, Agent, or Firm*—Fulbright & Jaworski L.L.P.

[57] ABSTRACT

A system and method for determining a weight of a postal item from information associated with the generation of the postal item. A processor-based system accepts input of information including parameters associated with the context in which the postal item is being generated. These parameters may be accepted directly from a process which is generating the postal item or may be manually input. From these parameters, the system determines attributes of the postal item from which a determination of its weight may be made. The attributes may be specific to postal items generated by a particular user of the system or may be attributes found to generally represent postal items generated in the particular context indicated by the parameters.

52 Claims, 2 Drawing Sheets

SYSTEM AND METHOD FOR DETERMINATION OF POSTAL ITEM WEIGHT BY CONTEXT

REFERENCE TO RELATED APPLICATIONS

The present application is being concurrently filed with U.S. application Ser. No. 08/725,119, pending, entitled "SYSTEM AND METHOD FOR REMOTE POSTAGE METERING" and U.S. application Ser. No. 08/727,833, pending, entitled "SYSTEM AND METHOD FOR RETRIEVING POSTAGE CREDIT CONTAINED WITHIN A PORTABLE MEMORY OVER A COMPUTER NETWORK," each having a common assignee, which applications are hereby incorporated by reference.

TECHNICAL FIELD OF THE INVENTION

This invention relates, in general, to a system and method, under the control of a general purpose computer, for determining a weight and thus a proper amount of authorized postage necessary to mail a postal item. More specifically, the invention relates to a system and method that determines postal weight of a postal item including a document produced from a processor-based system. The system utilizes information available from the processor-based system, or applications associated therewith, about the document, such as the number and size of pages and the context in which the document is to be printed, to make the determination of weight.

BACKGROUND OF THE INVENTION

Presently, it is common for individuals or businesses to have residing within their offices a system for generating and printing various forms of correspondence, or other postal items, and a postage meter to apply the postage necessary to mail such items. This arrangement is very convenient, since correspondence may be generated, printed, addressed, postage applied, and mailed directly from the office.

Quite naturally, postage meters were developed to relieve the manual application of stamps on mail and to automate the above process. Nevertheless, a postage meter residing within an office is not as convenient and efficient as it may first seem to be. As the meter is typically not interfaced with the system generating postal items, a postage meter must either be supplied with a correct amount of postage or must be supplied with the postal item's weight so that the postage amount may be calculated. This is so, even though the system generating the postal item may have information sufficient to allow a determination of weight and/or necessary postage.

Lesser expensive postage meters typically do not have a balance or scale integrated therein, thus requiring the user to estimate the amount of postage necessary to mail the item. This results in inefficiency as often an excess of postage will be applied to avoid the item's return for insufficient postage. Alternatively, a scale and, typically a manual, calculation of the necessary postage may be utilized with a lesser expensive postage meter to aid in the application of a proper amount of postage. However, this solution still requires the user of the metering system to perform steps in addition to the metering of postage.

A more expensive meter may have, incorporated therein, a postage scale to allow the weighing, calculation and application of postage as a single metering step. Meters offering this solution typically suffer from not only the added expense associated with the more complicated unit, but also the inability to determine and apply postage to a yet to be completed postal item. For example if a postal item is known to include multiple pages, but some or none of these pages have actually been produced, the meter is unable to weigh and, therefore, unable to calculate a correct amount of postage. The user must wait for the postal item to be completely assembled in its final form for application of postage or forego the convenience of the meter calculating the postage amount.

A more recent solution to postage metering is disclosed in U.S. Pat. No. 5,510,992 entitled SYSTEM AND METHOD FOR AUTOMATICALLY PRINTING POSTAGE ON MAIL, assigned to Post N Mail, L. C., Houston Tex., hereby incorporated by reference. There the disclosed metering system provides for the sale of postage credit on portable processor devices to be later utilized in a processor-based postage metering system. However, such a system, although considerably more convenient than the traditional metering systems discussed above, still requires the input by an operator or a coupled device, of a weight or desired amount of postage. Although typically more convenient that a traditional metering device, this more recent solution still suffers from the disadvantage of requiring input of either a postage amount or weight by various means.

A need in the art therefore exists for a system and method that determines the weight of a postal item from information available within a system or process which creates the postal item, or a significant portion thereof. Moreover, there is a need in the art for a system which provides for the determination of this weight utilizing an interface with a separate process associated with the generation of the postal item.

A further need in the art exists for a system and method which calculates a correct amount of postage automatically from this determination of postal item weight.

It is, therefore, advantageous for the determination of postal item weight to be accomplished by a system coupled to a postage metering device which can be coupled to other programs, such as word processing, spread sheet, accounting, database, or graphics programs.

SUMMARY OF THE INVENTION

The present invention addresses the above-described problems of determining and applying a proper amount of postage by providing a system and method whereby the determination of postal item weight and, therefore, a correct amount of postage is accomplished by utilizing information available within a process generating the postal item in conjunction with additional information, such as weights associated with particular sizes and types of paper stock. The information associated with a particular postal item created, or to be created, by a coupled process is used by the present invention in making a determination as to the weight of the postal item without any direct input of weight information of the particular postal item. The present invention may make a course estimate of postal item weight by utilizing only limited information with respect to the particular postal item in conjunction with typical parameters, such as a typical weight of paper stock and size and weight of envelope. Alternatively, the present invention may make a precise determination of postal item weight by utilizing more specific information associated with the generation of the postal item.

It will be appreciated that a technical advantage of the present invention is that a correct amount of postage can easily be determined without explicit weight information associated with a particular postal item being input.

A further technical advantage is that the determination of weight of a particular postal item may be accomplished without the need for a scale or balance.

A still further technical advantage of the present invention is that determination of the weight of a postal item is accomplished nearly instantaneously and automatically without a requirement of interaction of an operator or the separate step of weighing a postal item.

A yet further technical advantage of the present invention is that a correct amount of postage may be determined prior to the actual physical generation of a postal item. It shall be appreciated that such a determination prior to the postal item being generated is advantageous as delay may be avoided in waiting for the postal item to be generated by sometimes slow physical means. Additionally, early determination of postal item weight allows the correct amount of postage to be provided, and therefore printed, within the postal item itself upon its generation.

These and other needs and advantages are met in a preferred embodiment of the present invention, in which a processor-based system (PC) is located within a business' office or an individual's home. The PC stores a program, hereinafter referred to as the "determination" program, which accepts information from a user, a coupled device, or a coupled process regarding a postal item, such as a number of pages and the context in which it is being created or sent. The determination program subsequently makes a determination as to the weight of this particular postal item as a function this item specific information and other general information, such as the weight of particular paper stock. From this determination of weight, the determination program may calculate a correct amount of postage using a coupled postal rate table. In a preferred embodiment, the Demand program is also able to automatically calculate the correct postage to place on a letter, parcel or label as a function of the class, zone and weight of the particular item to be mailed. Alternatively, the determination program may communicate the weight to a separate process, such as a postage calculation program or metering system.

The determination program may be coupled to a word processing program, or other process, residing within the PC, thus allowing automation of the determination of postal item weight as well as alleviating the user from inputting duplicitous information. The determination program may utilize information from the coupled process to determine a weight of the postal item from the context of the correspondence, such as size or weight of paper, draft or correspondence mode, etcetera. The user of such a system may simply indicate a particular file, or other data packet, printed, or to be printed, by the PC which the determination program may then determine weight and/or a correct amount of postage. Alternatively, the user may cause the coupled process to transmit an electronic copy of the postal item to the determination program for use by the determination program in ascertaining information necessary to make the weight determination.

Thereafter, this information may be utilized for such functions as to request and subsequently print a meter stamp or other postage indicia for this postal item. Of course, where the determination program is coupled to a postage metering device, such as the processor-based postage metering system of the above incorporated U.S. patent, the weight determination and/or postage calculation may be communicated to the postage meter for generation of a postage indicia.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

The present invention provides for the automatic determination of a postal item's weight utilizing information associated with the generation of the postal item, such as number and size of pages, print mode or quality, and a type of application or context in which the postal item is being generated. This information shall hereinafter be referred to collectively as "generation" parameters or information. However, it shall be appreciated that an item may have been previously generated and still the present invention may determine its weight by information consistent with that of the generation parameters disclosed herein.

Such a system may be utilized independent of other applications, or may be utilized in conjunction with, or as an integral part of, other processes. For example, the present invention may accept postal item generation information from a coupled process, such as a word processor, spread sheet, accounting system, or graphics application or may simply accept input from an operator. Similarly, the postal item weight so determined may be output for use by an operator or may be communicated to a coupled process, such as a postage metering system, for utilization in generation of a postage meter stamp. Examples of processor-based postage metering systems to which the present invention may advantageously be coupled are disclosed in the above referenced U.S. patent as well as the above referenced concurrently filed U.S. patent applications.

Figure 1:
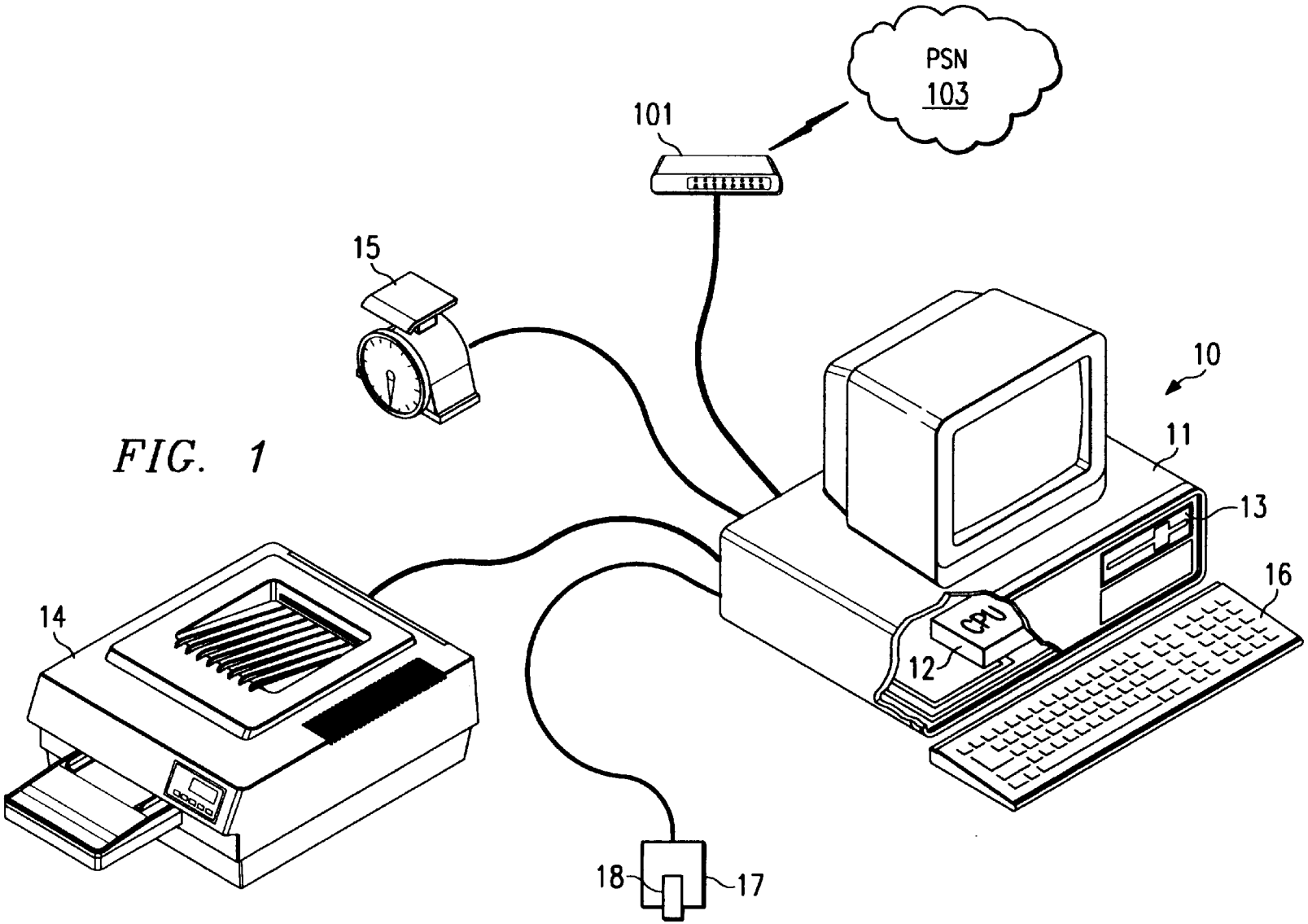
FIG. 1 illustrates a processor-based system of the preferred embodiment of the present invention.

Referring to FIG. 1, there is illustrated processor-based system 10 utilized in the preferred embodiment of the present invention. Specifically, PC 10 is utilized to implement the aforementioned determination program and may also be utilized to implement other processes to be coupled to the present invention. PC 10 includes chassis 11 enclosing processor (CPU) 12 and disk drive 13. PC 10 is a general purpose computer, such as an IBM compatible (or APPLE MACINTOSH) controlled by any general purpose operating system such as DOS or UNIX.

Furthermore, PC 10 may be adapted for receiving postal credit stored in portable storage device 18 through a receiving device 17. However, it shall be understood that the use of postage credit to print a meter stamp is not required by the present invention and such device is shown only to illustrate the determination program's possible coupling to other processes and devices.

Still referring to FIG. 1, it can be seen that PC 10 may be linked to other systems through Public Switched Network (PSN) 103 via modem 101 to either accept postal item generation or attribute information or to communicate a determined postal item weight or correct postage amount. PSN 103 may be comprised of any number of now existing or later to be developed communications means. In the preferred embodiment, PSN comprises public telecommunications lines and switching equipment. Alternatively, PSN 103 comprises digital communication over the Internet or similar wide area public gateway. Additionally, PC 10 may be linked to other systems directly through digital telecommunications trunks (not shown) or through a digital network system (not shown). It shall be understood that, in utilizing a digital network system to link PC 10 to other systems, modem 101 may be replaced by a network interface card (NIC) or other digital communication device, e.g., ISDN. It will be appreciated by those of skill in the art that any network linking PC 10 may either be secure or not depending on the degree of communication security desired.

With further reference to PC 10 illustrated in FIG. 1, printer 14 and balance 15 are depicted. Printer 14 is coupled to CPU 12 and provides output means for a determined postal item weight and is, of course, optional if printing of the determined weight is not desired.

Balance 15 is also coupled to CPU 12 and provides automated input of the weight of particular items. As the present invention determines a postal item weight through the use of generation parameters and postal item attributes, such a balance is of course optional. However, the use of balance 15 may be advantageous in initializing attributes associated with postal items, such as the weight of particular paper stock. Furthermore, balance 15 may advantageously be utilized with a coupled postage metering system when a postal item is not generated upon PC 10 and, therefore, its generation parameters are not available to the determination program. However, it shall be appreciated that an operator of the determination program may manually input any necessary information, such as by utilizing keyboard 16 of PC 10, if desired.

Figure 2:
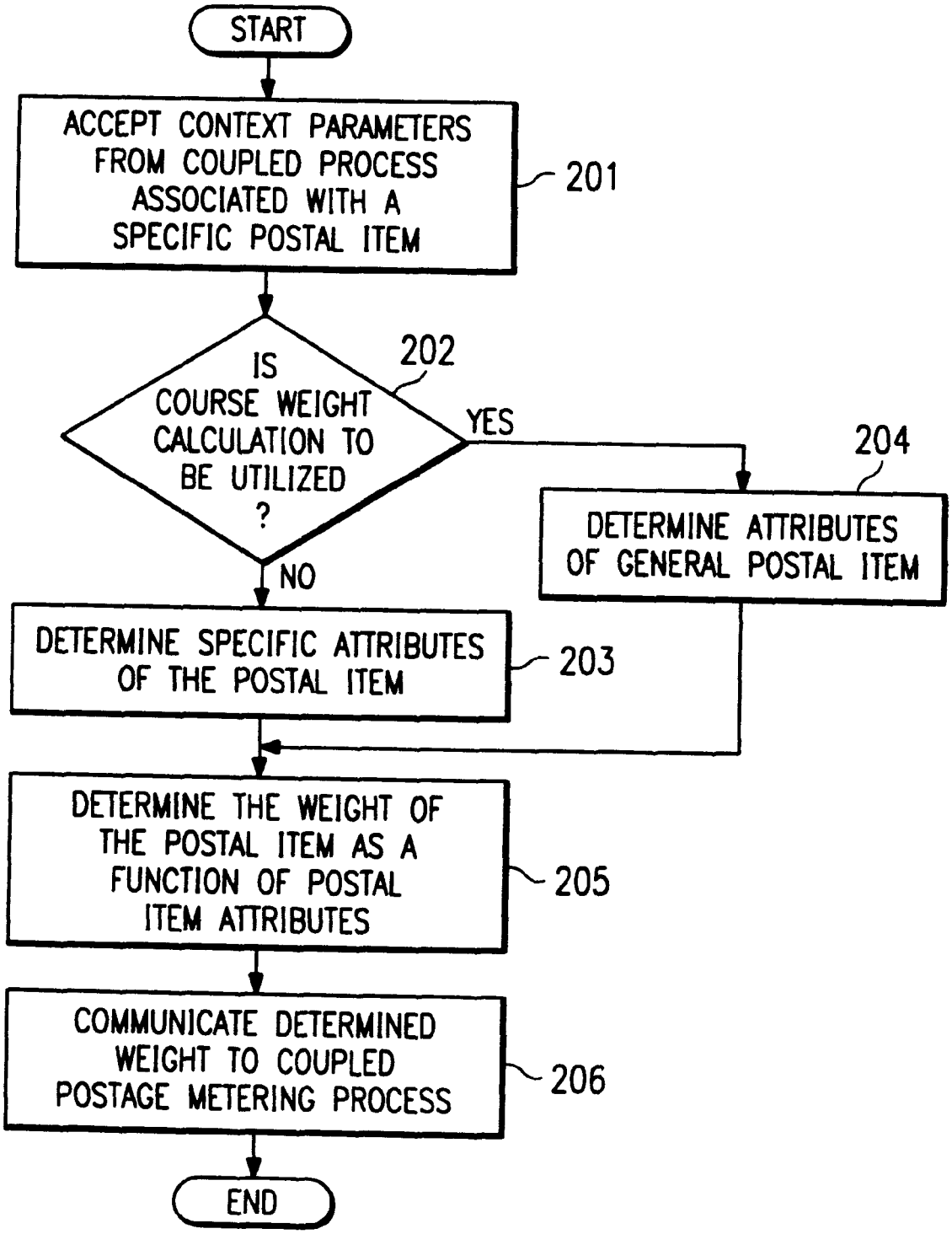
FIG. 2 illustrates a flow diagram of the preferred embodiment of the determination process of the present invention.

Directing attention to FIG. 2, a flow diagram of the preferred embodiment of the determination program is depicted. Upon activation of the determination program, the process accepts generation parameters associated with a particular postal item (step 201). These generation parameters include information regarding the paper size and number of pages as well as the specific context of the document, such as being a word processing draft etcetera. This generation information, which is typically readily available ancillary to the generation of a document, provides information from which a conclusion as to weight affecting attributes, such as the paper stock and associated envelope, utilized in conjunction with the generated document may be made.

In the preferred embodiment, generation parameters are extracted from a coupled process, such as a word processor. For example, in a multitasking environment, such as the MICROSOFT WINDOWS operating environment, the determination program may reference a concurrently operating process to accept these generation parameters. Similarly, another process may communicate an electronic image of the postal item to the determination program to enable the determination program to extrapolate this information. For example, a word processor may "print" an electronic image of the postal item to a disk file which is subsequently utilized by the determination program to extrapolate the size and number of pages as well as the context in which it is being generated.

Alternatively, the determination program may prompt the operator for specific information with respect to the generation parameters of a specific postal item. It shall be understood, although individual prompting steps are not illustrated in FIG. 2, that accepting step 201 may include the substeps of prompting an operator for specific information input associated with the generation of a document.

At step 202, the determination program decides if it is to make a course (estimated) weight determination or a precise weight determination. If a precise weight determination is to be made the process continues to step 203 where specific attributes of the postal item are determined. Postal item specific attributes include such information as the paper stock weight utilized in a particular context, i.e., if a word processor is used to generate a correspondence quality letter with a paper size of 8.5 inches by 11 inches, weight determinations may be based on 20 pound stock.

It shall be appreciated that postal item attributes may by input into the determination program at step 203 by an operator although FIG. 2 does not illustrate such individual substeps. Preferably, however postal item attributes are stored in an array associated with the determination program prior to the determination of weight, such as, for example, upon initialization of the determination program. Methods for initializing a data array are well known in the art and will not be discussed in detail here.

A table is presented below depicting specific attribute information that may be included in an array associated with the determination program of the present invention.

Context Specific Attribute Information

| Process | Paper Size | Print Mode | Paper Stock Weight | Associated Envelope | Envelope Weight |
|---|---|---|---|---|---|
| Word Processor | 8.5 × 11 | Draft | 15# | #10 | .05 |
| Word Processor | 8.5 × 11 | Correspondence | 20# | #10 | .05 |
| Word Processor | 5 × 7 | Correspondence | 25# | N/A | N/A |
| Spread Sheet | 8.5 × 11 | N/A | 15# | 10 × 13 | .50 |
| Spread Sheet | 11 × 14 | N/A | 15# | 12 × 15 | .60 |

As illustrated in the above table, the context of correspondence quality printing from a word processor may be associated with 20 pound paper stock, whereas the context of draft quality printing from the same word processor may be associated with 15 pound paper stock.

Similarly, printing of information from a spread sheet may be associated with 15 pound paper. Here, however, it should be appreciated that N/A (not applicable) has been entered for the print quality entry. Such an entry results in the utilization of the same paper stock weight for any mode or quality of printing. Of course, where different paper stock is to be used, an appropriate print mode entry may be made.

Although not shown in the above array, information associated with the number of copies of a particular form may also be included in the attribute array. For example invoices or statements from an accounting program may be associated with two parts, or two copies, where, for example, a customer copy and payment copy are posted to customers. Such information is, of course, helpful to the correct determination of weight by the present invention.

It shall be appreciated, in order to precisely determine a postal item's weight, that not only the pages of the particular document must be taken into consideration, but so to must its container or other associated items. Therefore, in addition to the specific paper stock weight to be associated with a particular context of a postal item, i.e., a word processor document printed on 8.5 inch by 11 inch paper in correspondence print quality mode will do so on 20 pound paper, envelope information may also stored within the array.

As shown in the above table, the postal item attribute array includes the type of envelope used in a particular context and its associated weight for use in the precise determination of postal item weight. This array may be expanded to include information with respect to a different envelope being used, and therefore a different weight, depending on the total number of pages associated with a document. However, a less precise postal item weight determination may be made by the determination program utilizing a typical envelope weight for all or some postal item weight determinations, if desired.

It shall be appreciated that the weight of particular types of envelopes may be input into the array in a number ways. For example, information with respect to a number of common envelopes may be included in the determination program initially. Alternatively, a balance, such as balance 15, may be used to accurately input weight information with respect to particular envelopes used by an operator.

It shall be appreciated that the attribute information associated with a word processing document having a paper size of 3 inches by 5 inches does not include an envelope entry. This is so because, in this example the context results in a post card being printed. Of course, where such a form size is to be posted within an envelope or other container, such information should be included in the array.

It shall be understood that in order to make a precise postal item weight determination with respect to a particular user, information in the attribute array must, at least in part, be input that is specific to the particular user. For example, the weight of paper stock for a particular context should be entered for the user. Likewise, the particular envelope weight for a particular context should also be entered for a particular user for a precise postal item weight determination. However, it shall be appreciated that typically one such array may be constructed for any single installation and still allow for precise determinations where all users generate postal items similarly.

Alternatively, if the determination program is to make a course determination of weight, as decided at step 202, the determination program proceeds to step 204 where general postal item attributes are utilized. It shall be appreciated, simply by knowing the size and number of pages of correspondence, that generally a very close approximation of the required postage may be calculated based on a general or common paper weight and envelope size. Therefore, the general postal item attributes used in the course determination of postal item weight may simply be default values selected because of their typicality in particular contexts. These default values may be embodied in an array as illustrated above for the specific attributes, but they do not require customized input from a user. Alternatively, general postal item attributes may be reduced to a single set of attributes determined to best represent postal items generated by processor-based systems such as PC 10. For example, the general attributes may always assume that 20 pound paper stock is to be used in combination with a number 10 glassine windowed envelope.

Of course, where it is determined that only one method of determining postal item weight is to be utilized, that being either course or precise, decision step 202 as well as one of the alternative steps of 203 and 204 may be omitted, if desired.

At step 205 the determination program makes its determination of the postal item weight based on the accepted generation parameters and postal item attributes. The postal item weight determination is a function of these parameters such that the number of pages are multiplied by a weight per page as calculated from the paper stock weight and paper size and summed with any additional weight information, such as an associated envelope or any additional weight added to the paper stock by the actual generation of the document.

Thereafter, this information is communicated to a coupled postage metering process to be used in metering a correct amount of postage (step 206). Alternatively, the determination may present the determined weight to an operator of the system or some other process rather than communicating the information to a metering system. Of course, the determination program may utilize the postal item weight in conjunction with postal rate information to calculate a correct amount of postage to be applied to the postal item (not shown), if desired.

Upon completion of the steps illustrated in FIG. 2, the determination program may either terminate its execution, thus returning control of PC 10 to another process, or return to an earlier step to continue the process again. It shall be understood that, although the foregoing discussion disclosed the determination of weight for a single postal item, that multiple determinations may be made in any session.

It shall be appreciated, although a preferred embodiment of the present invention has been disclosed to provide a determination of postal item weight from the generation of a document to be posted, that the present invention is not limited to use with postal items. As such, the present invention may be utilized to determine an ultimate weight of any item resulting from a composite of components of known or calculable weights.

Although the present invention and its advantages have been described in detail, it should be understood that various changes, substitutions and alterations can be made herein without departing from the spirit and scope of the invention as defined by the appended claims.

What is claimed is:

1. A system for automatically determining the weight of a postal item including at least one object, said system comprising:

means for establishing generation parameters for said object;

means for establishing attributes specific to said generation parameters, said attributes including information associated with said postal item exclusive of a weight of said postal item; and means for calculating a weight of said postal item as a function of said generation parameters and said attributes.

2. The system of claim 1, wherein said calculating means operates to calculate said weight of said postal item prior to generation of said object.

3. The system of claim 1, wherein said generation parameters comprise a size associated with said object.

4. The system of claim 1, wherein said generation parameter establishing means comprises means for accepting at least a portion of said generation parameters from a separate process in information communication with said system.

5. The system of claim 1, wherein said generation parameter establishing means comprises means for accepting at least a portion of said generation parameters from an operator of said system.

6. The system of claim 1, wherein said attribute establishing means comprises means for accepting at least a portion of said attributes from a predetermined data array stored in said system.

7. The system of claim 1, wherein said attribute establishing means comprises means for accepting at least a portion of said attributes from an operator of said system.

8. The system of claim 1, wherein said generation parameters comprise a number of component parts of said object.

9. The system of claim 8, wherein ones of said component parts comprise individual pages of a document.

10. The system of claim 1, wherein said attributes comprise information indicating a paper stock weight.

11. The system of claim 10, wherein said attributes are modifiable by a user of said system.

12. The system of claim 1, wherein said generation parameters comprise information associated with a context in which said object is generated.

13. The system of claim 12, wherein said context information comprises information indicating a particular type of process utilized to generate said object.

14. The system of claim 13, wherein said particular type is selected from the group consisting of a word processor program, a spread sheet program, an accounting program, and a graphics program.

15. The system of claim 13, wherein said context information comprises information associated with a mode of output of said object by said process.

16. The system of claim 1, wherein said attributes comprise information associated with a container to be utilized as a portion of said postal item.

17. The system of claim 16, wherein said container comprises an envelope.

18. The system of claim 16, wherein said attributes further comprise information associated with an alternative container to be utilized as a portion of said postal item upon the occurrence of a condition.

19. The system of claim 18, wherein said condition is a number of pages associated with a component of said object exceeding a predetermined amount.

20. The system of claim 16, wherein said attributes comprise a weight associated with said container.

21. The system of claim 20, wherein said calculating means further comprises a function of said weight associated with said container.

22. A method for determining the weight of an item including at least a document, said method comprising the steps of:

establishing generation parameters for said document;

establishing attributes specific to said generation parameters, said attributes including information associated with said document exclusive of a weight of said item; and calculating a weight of said item as a function of said attributes.

23. The method of claim 22, wherein said generation parameters comprise a document size associated with said document.

24. The method of claim 22, wherein said generation parameters comprise a number of pages associated with said document.

25. The method of claim 22, wherein said generation parameter establishing step comprises the substep of accepting at least a portion of said generation parameters from an independent process.

26. The method of claim 22, wherein said generation parameter establishing step comprises the substep of accepting at least a portion of said generation parameters from an operator substantially concurrent with said calculating step.

27. The method of claim 22, wherein said attributes comprise information indicating a paper stock weight.

28. The method of claim 22, wherein said attributes are modifiable by a user of said system.

29. The method of claim 22, wherein ones of said attributes are preselected to be general document attributes.

30. The method of claim 22, wherein said attribute establishing step comprises the substep of accepting at least a portion of said attributes from a predetermined data array.

31. The method of claim 22, wherein said attribute establishing step comprises the substep of accepting at least a portion of said attributes from an operator substantially concurrent with said calculating step.

32. The method of claim 22, wherein said generation parameters comprise information associated with a context in which said document is generated.

33. The method of claim 32, wherein said context information comprises information indicating a particular type of process utilized to generate said document.

34. The method of claim 33, wherein said particular type of process is selected from the group consisting of a word processor program, a spread sheet program, an accounting program, and a graphics program.

35. The method of claim 33, wherein said context information comprises information associated with a quality of output of said document by said process.

36. The method of claim 22, wherein said attributes comprise information associated with a container to be utilized as a portion of said item.

37. The method of claim 31, wherein said attributes further comprise information associated with an alternative container to be utilized as a portion of said item upon the occurrence of a condition.

38. The method of claim 37, wherein said condition is a number of pages associated with said document exceeding a predetermined value.

39. The method of claim 36, wherein said attributes further comprise a weight associated with said container.

40. The method of claim 39, wherein said calculating step further comprises a function of said weight associated with said container.

41. In combination with a postage metering apparatus, a system for determining a weight of a postal item, said system comprising:

means for establishing a plurality of genesis parameters for a document associated with said postal item, said genesis parameters including a page size and a number of pages associated with said document;

means for establishing characteristics specific to ones of said plurality of genesis parameters, said characteristics including information associated with said postal item being generated consistent with said genesis parameters, said characteristics being accepted at least in part from a predetermined data array associated with said system;

means for calculating a weight of said postal item as a function of ones of said plurality of genesis parameters and said characteristics; and means for communicating said calculated weight to said postage metering apparatus.

42. The system of claim 41, wherein said calculating means comprises means for determining a correct amount of postage for said postal item, and said means for communicating communicates said correct amount of postage to said postage metering apparatus.

43. The system of claim 41, wherein said metering apparatus operates to cause a meter stamp to be included in said document upon genesis of said document.

44. The system of claim 41, wherein said characteristics comprise information indicating a paper stock weight.

45. The system of claim 41, wherein said characteristics comprise information associated with a container to be utilized as a portion of said item.

46. The system of claim 45, wherein said characteristics comprise a weight associated with said container.

47. The system of claim 46, wherein said calculating step further comprises a function of said weight associated with said container.

48. The system of claim 41, wherein said plurality of genesis parameters further includes information associated with a context in which said document is generated.

49. The system of claim 48, wherein said context information comprises information indicating a particular type of process utilized to generate said document.

50. The system of claim 49, wherein said particular type of process is selected from the group consisting of a word processor program, a spread sheet program, an accounting program, and a graphics program.

51. The system of claim 49, wherein said context information comprises information associated with an output quality of said document by said process.

52. The system of claim 49, wherein said genesis parameter establishing means further comprises means for accepting at least a portion of said plurality of genesis parameters from an independent process.

* * * * *